US008177607B2

(12) United States Patent
Herbin et al.

(10) Patent No.: US 8,177,607 B2
(45) Date of Patent: May 15, 2012

(54) DEVICE FOR BLOCKING OPTICAL ELEMENTS

(75) Inventors: Patrick Herbin, Charenton le Pont (FR); Jean-Marie Keller, Charenton le Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 993 days.

(21) Appl. No.: 12/159,275

(22) PCT Filed: Dec. 26, 2006

(86) PCT No.: PCT/FR2006/002876

§ 371 (c)(1),
(2), (4) Date: Jun. 26, 2008

(87) PCT Pub. No.: WO2007/074240

PCT Pub. Date: Jul. 5, 2007

(65) Prior Publication Data

US 2008/0299881 A1 Dec. 4, 2008

(30) Foreign Application Priority Data

Dec. 27, 2005 (FR) ..... 05 13360

(51) Int. Cl.
*B24B 41/06* (2012.01)

(52) U.S. Cl. ..... 451/384; 451/390

(58) Field of Classification Search ..... 100/211, 100/212; 269/21; 451/41, 42, 43, 240, 255, 451/256, 277, 323, 384, 386, 390
See application file for complete search history.

(56) References Cited

U.S. PATENT DOCUMENTS

| | | | | |
|---|---|---|---|---|
| RE31,897 | E * | 5/1985 | Johnson | 451/42 |
| 4,831,789 | A * | 5/1989 | Herbin et al. | 451/495 |
| 5,421,771 | A * | 6/1995 | Wardle | 451/390 |
| 5,916,017 | A * | 6/1999 | Sedlock | 451/460 |
| 7,559,829 | B2 * | 7/2009 | Stephane et al. | 451/512 |
| 2004/0110452 | A1 | 6/2004 | Incera et al. | |

OTHER PUBLICATIONS

International Search Report dated Jun. 18, 2007, in PCT application.

* cited by examiner

*Primary Examiner* — Timothy V Eley
(74) *Attorney, Agent, or Firm* — Young & Thompson

(57) ABSTRACT

A locking device includes a rigid base (2) and a deformable pocket (3) containing a granular material (13). Discharging elements (4) are provided for gas exchange between the inside and the outside of the deformable pocket (3).

26 Claims, 3 Drawing Sheets

DEVICE FOR BLOCKING OPTICAL ELEMENTS

The invention concerns the field of fabrication of optical elements such as ophthalmic lenses.

The invention concerns more particularly a blocking device that can be attached to one of the faces of an optical element in order to hold that optical element during machining of its opposite face.

For example, methods of producing correcting eyeglasses generally include steps of machining and/or polishing ophthalmic lenses and then of mounting the lenses in an eyeglass frame.

Some of these machining and/or polishing operations are carried out while holding the ophthalmic lens by means of a blocking device attached to one of its faces while a tool operates on the opposite face of the ophthalmic lens.

A known solution for attaching a block to one of the faces of an ophthalmic lens uses a low melting point metal alloy or wax. The alloy or wax is first heated to melt it and then applied to the ophthalmic lens, whose shape it espouses. The combination is then cooled and the metal alloy or wax hardens to form a block attached to the ophthalmic lens. An adhesive can also be inserted between the ophthalmic lens and the alloy or wax.

Moreover, the document DE 39 24 078 describes a rigid block that can be attached to an ophthalmic lens by reducing the pressure in the space between the ophthalmic lens and the rigid block.

The document U.S. Pat. No. 6,863,602 for its part describes a block including a rigid base to which is fixed a deformable pocket filled with a fusible material. The block is heated to melt the fusible material and is then applied to the ophthalmic lens so that the deformable pocket espouses the shape of the ophthalmic lens. The combination is then cooled to harden the fusible material. Cooling the fusible material also causes shrinkage of the deformable pocket relative to the ophthalmic lens, thus creating a reduced pressure holding the block against the ophthalmic lens.

The object of the invention is to improve this type of blocking device for an optical element.

To this end, a first object of the invention is directed to a device for blocking optical elements, including a rigid base and a deformable pocket attached to the rigid base, characterized in that the deformable pocket contains a granular material and in that it includes evacuation means adapted to provide for exchange of gas between the interior and the exterior of the deformable pocket and sealing means adapted to assure sealed contact between the deformable pocket and an optical element when the latter is in place against the deformable pocket.

Such a blocking device provides optimum holding of the optical element by espousing the shape of that optical element, thanks to the deformable pocket containing a granular material, without recourse to consumable products such as a metal alloy or a wax, which are costly and represent environmental and health hazards.

Moreover, reducing the pressure in the space situated between the optical element and the deformable pocket attaches the blocking device to the optical element and also, thanks to the evacuation means, reduces the pressure inside the deformable pocket in order to stiffen it.

The change of state of the deformable pocket, which goes from a rigid state to a malleable state and vice-versa, consequently necessitates no heating/cooling cycle with the risk of damaging the optical element.

For a simpler assembly, the deformable pocket can be fixed and sealed to the rigid base.

According to a preferred feature, the evacuation means include a rigid finger projecting from the rigid base and an external section of which projects out of the deformable pocket.

Such a rigid finger allows exchange of gas between the interior and the exterior of the deformable pocket, regardless of the position and shape of the pocket.

The rigid base is preferably circular with a central axis and the external section of the rigid finger preferably extends along this central axis.

The rigid base can therefore be clamped in the jaws of a conventional machine for polishing optical elements.

To provide for the exchange of gas, the rigid finger can include a passage extending along its external section and discharging on the one hand outside the deformable pocket and on the other hand inside the deformable pocket in such a manner as to provide for the exchange of gas.

The external section of the rigid finger can equally be porous to provide for this exchange of gas.

To guarantee the accuracy of machining, the external section of the rigid finger can include a bearing surface for an optical element.

According to a preferred feature, the sealing means can include an O-ring.

The sealing means can moreover be fixed to the deformable pocket or formed directly by a protrusion on the deformable pocket.

According to another preferred feature, the deformable pocket has spacer members on its external surface adapted to maintain a distance between the deformable pocket and an optical element when the latter is in place against the deformable pocket.

These spacer members guarantee a minimum space between the surface of the optical element and the deformable pocket, thanks to which the pressure between these two surfaces can be reduced.

These spacer elements can comprise pins and/or a spiral rib, for example.

Moreover, diverse features provide for optimum stiffening of the deformable pocket.

The granular material can advantageously be an incompressible material, for example, so that when the pressure inside the deformable pocket is reduced the pocket presses the grains together, thereby forming an undeformable mass.

The granular material can equally include grains of irregular shape and/or grains with facets, to prevent or limit slipping of the grains relative to each other for improved rigidity when the pressure inside the deformable pocket is reduced.

The granular material can advantageously include grains of glass and/or of sand.

In one embodiment, the blocking device can further include:

- an enclosure adapted to receive the rigid base, the deformable pocket, and an optical element; and
- means for reducing the pressure inside the enclosure.

Thanks to this enclosure and to the means for reducing the pressure in it, the device is able to attach an optical element by a method that is another object of the invention and includes the following steps:

- selecting a blocking device of the above kind;
- disposing the rigid base, the deformable pocket, and the lens inside the enclosure;
- reducing the pressure inside the enclosure;
- returning the interior of the enclosure to the original pressure;

recovering the rigid base, the deformable pocket, and the lens fastened together.

The method can further include, before the step of reducing the pressure inside the enclosure, the step of pressing one of the faces of the optical element against the deformable pocket so that the latter at least partially espouses the shape of the optical element.

According to one preferred feature, the blocking device further includes means for retaining the rigid base inside the enclosure and these retaining means can be spring-mounted. To be more precise, the retaining means can include a receptacle mounted on a slideway and said spring, which urges the receptacle in the direction of the slideway.

Thus the optical element can be pressed against the deformable pocket with a force calibrated by the spring.

The blocking device can equally include a cover provided with means for urging an optical element against the deformable pocket when the rigid base is in place in said retaining means, which cover can include the retaining means for an optical element.

Thus the optical element can be fitted to the cover beforehand so that, in one operation, placing the cover on the enclosure closes the enclosure and presses the optical element against the deformable pocket.

Other features and advantages of the invention will become apparent in the light of the following description of a preferred embodiment, given by way of nonlimiting example, which description is given with reference to the appended drawings, in which.

Figure 1:
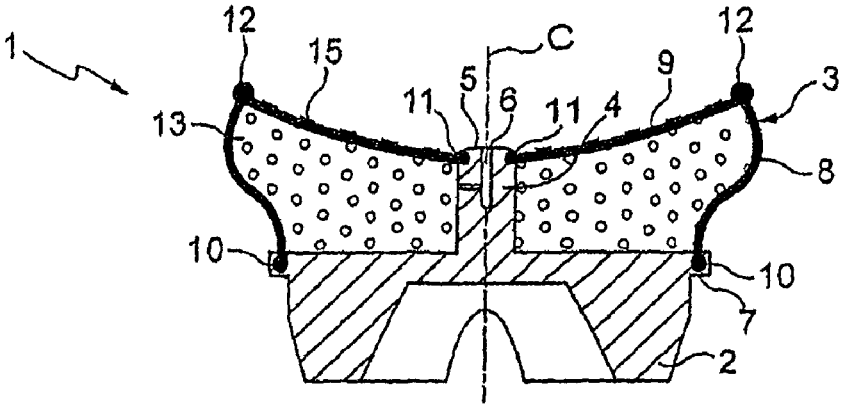
FIG. 1 is a lateral view in section of a blocking device of the invention.

FIG. 1 shows a blocking device formed by a block 1 that can be attached to an optical element. This block 1 includes a rigid base 2 and a deformable pocket 3 attached to the rigid base 2.

The rigid base 2 is circular with a central axis C. This rigid base 2 therefore has a shape enabling it to be clamped into the jaws of a machining machine. In this example, the rigid base 2 has a frustoconical portion adapted to a particular type of machining machine, it being understood that the shape of the rigid base 2 can be modified to adapt to other types of holding means, whether fixed jaws, rotary jaws, jaws mobile in translation, or suction or friction type holding devices.

The rigid base 2 includes a rigid finger 4 extending along the axis C on the same side as the deformable pocket 3. The rigid finger 4 has, at its end, a plane surface forming a bearing surface 5 for an optical element.

The rigid finger 4 further includes an internal passage 6 discharging on the one hand onto the bearing surface 5 at the end of the rigid finger 4 and on the other hand transversely to the rigid finger 4.

The rigid base 2 includes a circular shoulder 7 adapted to cooperate with the retaining device or the jaws of the machining machine so that, the dimensions of the rigid base 2 being known, the known position of the shoulder 7 relative to a machine reference determines the position of the bearing surface 5 relative to a machine reference. An optical element disposed against the bearing surface 5 is consequently disposed against a reference surface relative to the axes of the intended machining machine. This controls the thickness dimension of the lens along the axis C during machining. Moreover, if the angular orientation of the plane in which the optical element extends relative to the axis C is also known, the position of the optical element is then totally controlled relative to a machine reference.

In this example, this rigid base 2 is a one-piece steel casting.

Where the deformable pocket 3 of the block 1 is concerned, that pocket 3 consists of a flexible and impermeable membrane. In the present example it is a rubber or polyurethane membrane.

This deformable pocket 3 has a lateral portion 8 and a receiving portion 9.

The lateral portion 8 is a circular skirt attached and sealed to the rigid base 2 by means of a groove 10 on the periphery of the rigid base 2.

The receiving portion 9 is a disk the periphery of which is attached and sealed to the lateral portion 8 and the center of which has an opening through it through which the rigid finger 4 can pass. The receiving portion 9 is likewise attached and sealed to the rigid finger 4 by means of a groove 11 on the perimeter of the rigid finger 4.

The deformable pocket 3 is thus fixed and sealed to the rigid base 2, apart from the passage 6 in the rigid finger 4 that allows exchange of gas between the interior and the exterior of the deformable pocket 3.

Alternatively, the deformable pocket 3 can equally be formed of a single sheet of flexible material attached to the periphery of the rigid base 2 and also to the rigid finger 4.

The block 1 includes an O-ring 12 disposed over the entire periphery of the receiving portion 9. This O-ring 12 forms a circular lip that can be either attached to the receiving portion 9 or formed directly by a protrusion of the material forming the deformable pocket 3. If the material forming the deformable pocket 3 is suitable for forming a seal, the seal can be provided by direct contact of the deformable pocket 3 with an optical element.

The deformable pocket 3 is moreover filled with a granular solid material 13. This granular solid material 13 has been diagrammatically represented in the figures by a pattern of spaced and regularly distributed circles, it being understood that this is merely a diagrammatic representation designating any collection of grains, whether regular or not.

The solid granular material 13 can consist of any material sufficiently rigid to lock onto a lens when a vacuum is produced in the deformable pocket. This granular material 13 is preferably incompressible. The grains are preferably irregular and/or have facets and/or have a high coefficient of friction, all these characteristics aiming to ensure strong cohesion of all the grains when they are compressed together by the deformable pocket 3, the grains being mobile relative to each other when the deformable pocket 3 does not apply any pressure to them.

The granular material can be glass, sand or a polymer, for example. Molten wax or metal are not suitable for this kind of application.

The size of the grains is situated in a range including in particular balls, granules and powders.

Figure 2:
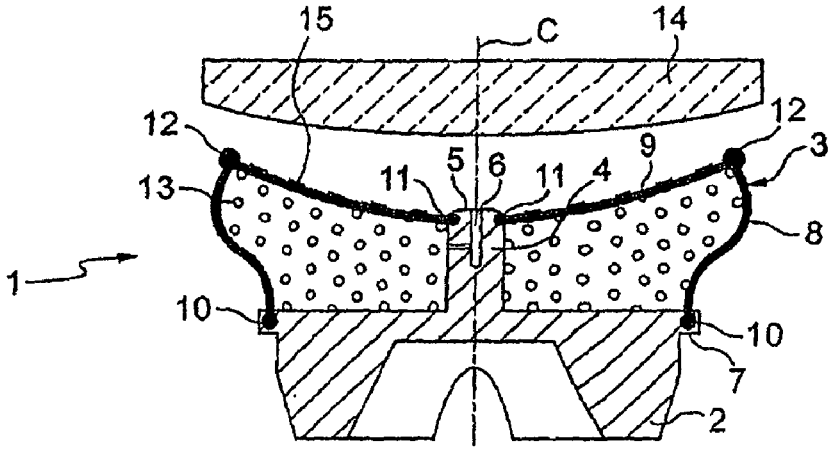
FIG. 2 shows the FIG. 1 blocking device offered up face to face with one of the faces of an optical element, itself seen in section.

Referring to FIG. 2, the diameter delimited by the O-ring 12 is preferably less than the diameter of the optical element 14 to which the block 1 is to be attached. The O-ring 12 can thus ensure sealed contact between the deformable pocket 3 and the surface of an optical element 14, as shown in FIG. 3.

Figure 3:
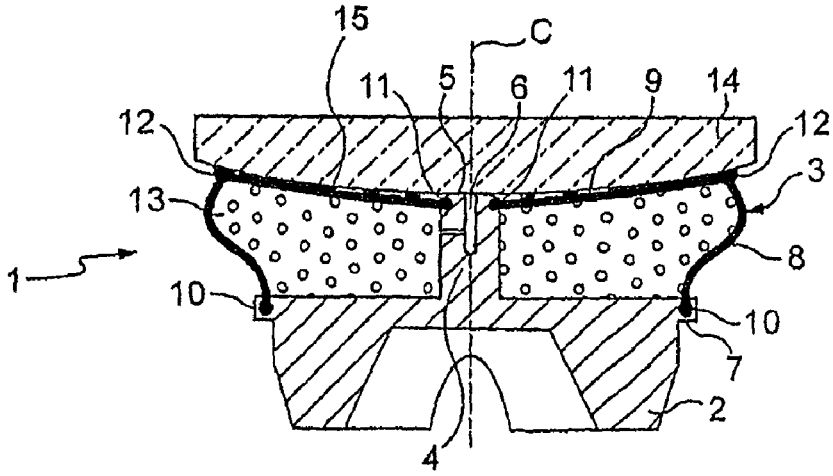
FIG. 3 represents the FIG. 2 device when it has been attached to the optical element.

Referring to FIG. 3, the block 1 is represented with an optical element 14 held against the bearing surface 5 of the rigid finger 4. In the present example, the optical element 14 is an ophthalmic lens. In this position, pins 15 disposed on the receiving portion 9 maintain a gap between the surface of the lens 14 and the surface of the receiving portion 9. A spiral groove around the rigid finger 4 can replace or supplement the pins 15, for example, and likewise any other means adapted to maintain a gap between the aforementioned two surfaces.

Figure 4:
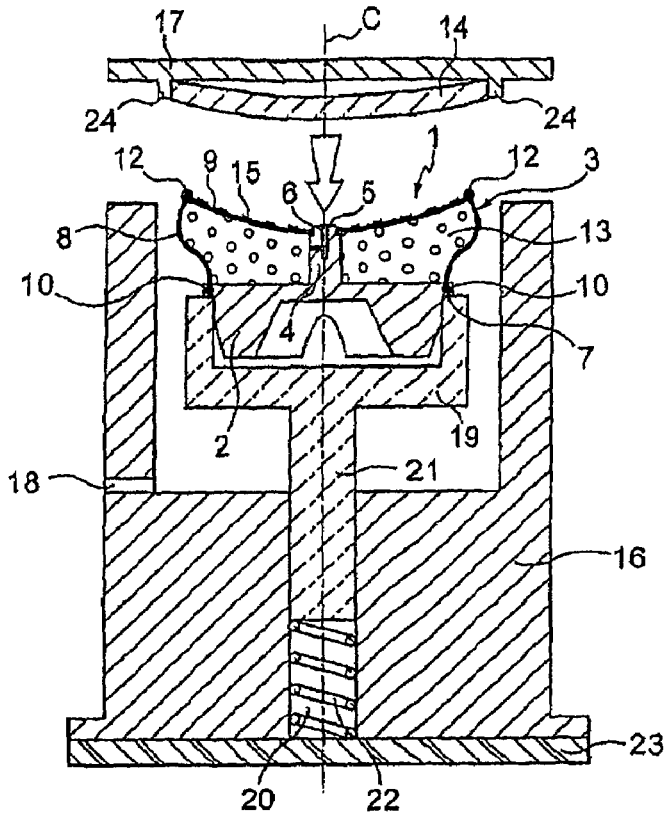
FIG. 4 is a view in section of the FIG. 1 blocking device further including an enclosure adapted to receive an ophthalmic lens.
Figure 5:
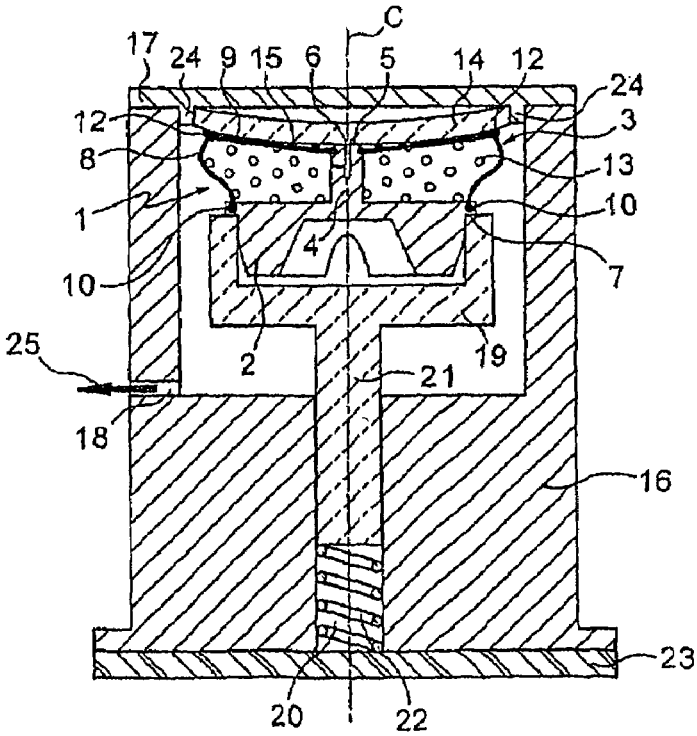
FIG. 5 represents the FIG. 4 device during a pressure reducing phase.

FIGS. 4 and 5 represent a blocking device including a block 1 like that from FIGS. 1 to 3 and used to attach this block to an ophthalmic lens 14.

This blocking device includes, in addition to the block 1, an enclosure 16 provided with a cover 17 adapted hermetically to seal the enclosure 16. The enclosure 16 also includes an orifice 18 connected to a pump (not shown).

Thus when the enclosure 16 is closed by the cover 17, the pressure inside it can be reduced by means of the pump connected to the orifice 18.

The cover 17 has, on its side facing toward the interior of the enclosure 16, holding lugs 24 for holding an ophthalmic lens 14 against the cover 17. In the present example these holding lugs 24 are adapted to hold the ophthalmic lens 14 by a buttressing effect. Any other way of holding the lens 14 against the cover 17 can be provided, for example by gluing it or by holding it with a clamp.

A receptacle 19 for the block 1 is disposed inside the enclosure 16. This receptacle 19 is adapted to receive the block 1 and to cooperate with the shoulder 7 of the block 1 to position it.

The receptacle 19 is mobile in translation along the axis C by means of a slideway 20 formed in the body of the enclosure 16 and a slider 21 fastened to the receptacle 19 and mounted to slide in the slideway 20.

The receptacle 19 is moreover urged in the direction of the cover 17 by a spring 22 disposed in the slide 20 and held against the slider 21 by a plate 23 fixed to the enclosure 16.

The blocking device that has just been described functions in the manner indicated hereinafter.

The ophthalmic lens 14 is first placed against the cover 17 and thus is held by the holding lugs 24. In parallel with this, the block 1 is placed in the receptacle 19 (see FIG. 4).

The cover 17 is then mounted on the enclosure 16 so that on the one hand the cover 17 hermetically seals the enclosure 16 and on the other hand the ophthalmic lens is placed against the block 1 so that the receiving portion 9 of the deformable pocket 3 espouses the shape of the lens 14. On mounting the cover 17, the lens 14 also comes into contact with the bearing surface 5 of the rigid finger 4.

It will be seen that, in the present example, the dimensions of the spring 22, the slider 21, the receptacle 19 and the enclosure 16 are such that, on mounting the cover 17 fitted with the lens 14, the lens 14 is positioned against the bearing surface 5 before the cover 17 reaches its closure position. Thus, according to FIG. 5, closure of the enclosure 16 by the cover 17 forces the lens 14 to push on the bearing surface 5, which depresses the assembly formed by the block 1, the receptacle 19 and the slider 21, which compresses the spring 22.

In the FIG. 5 setup, the spring 22 therefore urges the bearing surface 5 of the rigid finger 4 against the ophthalmic lens 14.

It will be seen that the force applied by the spring 22 can instead be adjusted by varying the position of the plate 23 or by means of a screw inserted into the plate 23 and forming an abutment for the spring 22.

Starting with the setup shown in FIG. 5, the pressure inside the enclosure 16 is then reduced by means of the pump connected to the orifice 18 (as indicated diagrammatically by the arrow 25).

This reduction of pressure must be relatively intense so that air contained in the deformed pocket 3 travels along the rigid finger 4 through the passage 6, to exit the volume delimited by the receiving portion 9, the surface of the ophthalmic lens 14 and the O-ring 12, passing the barrier consisting of the O-ring 12.

As pumping via the orifice 18 proceeds, the O-ring 12 vibrates or gives to allow air to pass out of the block 1 in the direction of the orifice 18.

When the pressure inside the enclosure 16 reaches a predetermined value, pumping is stopped and the orifice 18 is blocked. A relative pressure of approximately −0.8 bar is generally acceptable for this kind of predetermined pressure.

This predetermined pressure is then present inside the enclosure 16, but also inside the deformable pocket 3 and between the receiving portion 9 of the deformable pocket 3 and the surface of the ophthalmic lens 14.

The interior of the enclosure 16 is then returned to atmospheric pressure by opening the orifice 18.

Although this actually returns the interior of the enclosure 16 to atmospheric pressure, this does not apply to the interior of the deformable pocket 3 or to the volume situated between the receiving portion 9 and the surface of the ophthalmic lens 14, because of the O-ring 12 which, as it were, traps the reduced pressure between the block 1 and the ophthalmic lens 14.

Because of the reduced pressure inside the deformable pocket 3, the assembly comprising the deformable pocket 3 and the granular material 13 forms a rigid assembly espousing the shape of the ophthalmic lens 14.

The reduced pressure in the volume delimited by the receiving portion 9, the surface of the ophthalmic lens 14 and the O-ring 12 holds the lens 14 and the block 1 together.

The block 1 being attached in this way to one of the faces of the ophthalmic lens 14, the cover 17 can be removed from the enclosure 16 so that the block 1 is disengaged from the receptacle 19 and the means 24 then retain not only the lens 14 but also the block 1 that is attached to it. The assembly formed by the ophthalmic lens 14 and the block 1 is then detached from the holding lugs 24, and thus from the cover 17, and is therefore ready for mounting on a machining machine for the treatment of the face of the lens 14 that is opposite the block 1.

Figure 6:
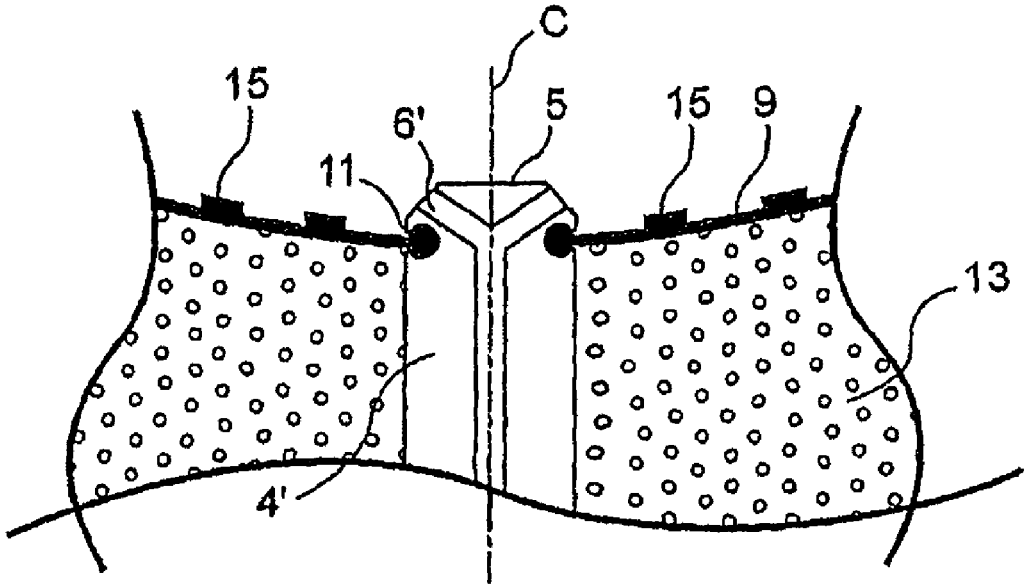
FIGS. 6 and 7 are detail views each showing a respective variant embodiment of the blocking device.
Figure 7:
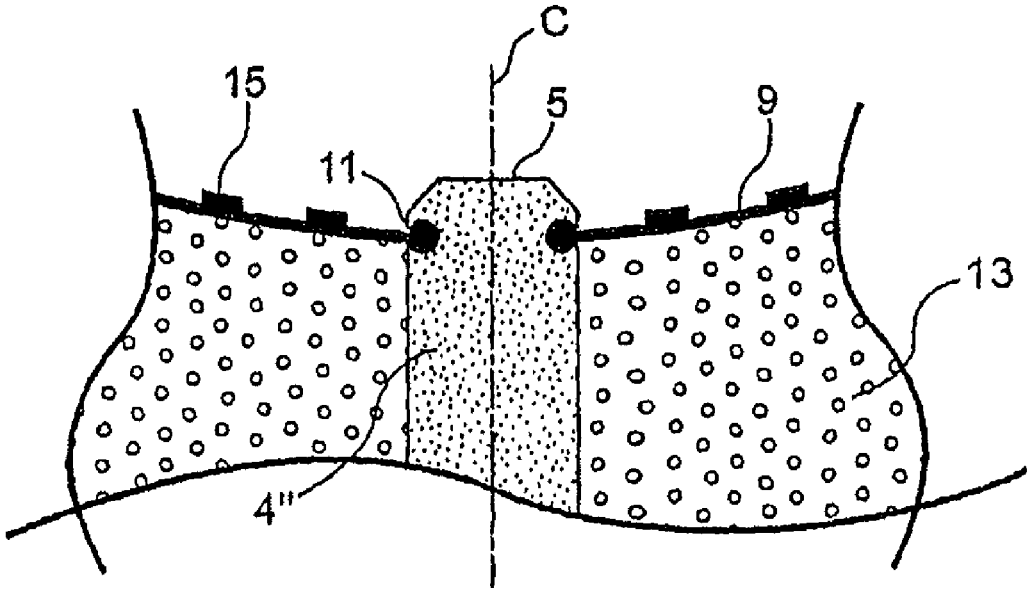

FIGS. 6 and 7 show different embodiments of the rigid finger 4 for ophthalmic lenses that would tend to block the passage 6 when in place against the bearing surface 5.

The FIG. 6 embodiment shows a rigid finger 4' including a Y-shape passage 6' which is duplicated to free the bearing surface 5, discharging on either side of that surface.

The FIG. 7 embodiment shows a rigid finger 4" consisting of a porous material so that the rigid finger 4" is vented over its entire surface.

The FIGS. 1, 6 and 7 variants of the rigid finger 4, 4', 4" can of course be combined.

Different embodiments of the device can be envisaged without departing from the scope of the invention. In particular, the rigid base 2 can have any shape adapted to a particular machining machine. Likewise, the rigid finger 4 can have a different disposition within the block 1 and can even be dispensed with if the venting function is assured directly by the receiving portion 9, for example by means of a perforation.

The invention claimed is:

1. Device for blocking optical elements (14), including a rigid base (2) and a deformable pocket (3) attached to the rigid base (2), characterized in that the deformable pocket (3) contains a granular material (13) and in that it includes evacuation means (4) adapted to provide for the exchange of gas between the interior and the exterior of the deformable pocket (3) and sealing means (12) adapted to assure sealed contact between the deformable pocket (3) and an optical element (14) when the latter is in place against the deformable pocket (3).

2. Blocking device according to claim 1, characterized in that the deformable pocket (3) is fixed and sealed to the rigid base (2).

3. Blocking device according to claim 1, characterized in that the evacuation means includes a rigid finger (4) projecting from the rigid base (2) and an external section of which projects out of the deformable pocket (3).

4. Blocking device according to claim 3, characterized in that the rigid base (2) is circular with a central axis (C) and in that the external section of the rigid finger (4) extends along this central axis (C).

5. Blocking device according to claim 3, characterized in that the rigid finger (4, 4') includes a passage (6, 6') opening at one end outside the deformable pocket (3) and at the other end inside the deformable pocket (3) in such a manner as to provide for the exchange of gas.

6. Blocking device according to claim 3, characterized in that the external section of the rigid finger (4") is porous to provide for the exchange of gas.

7. Blocking device according to claim 3, characterized in that the external section of the rigid finger (4) includes a bearing surface (5) for an optical element (14).

8. Blocking device according to claim 1, characterized in that the sealing means includes an O-ring (12).

9. Blocking device according to claim 1, characterized in that the sealing means (12) is fixed to the deformable pocket (3).

10. Blocking device according to claim 1, characterized in that the sealing means (12) is formed by a protrusion on the deformable pocket (3).

11. Blocking device according to claim 1, characterized in that the deformable pocket (3) includes spacer elements (15) on its external surface adapted to maintain a distance between the deformable pocket (3) and an optical element (14) when the latter is in place against the deformable pocket (3).

12. Blocking device according to claim 11, characterized in that the spacer elements (15) comprise pins.

13. Blocking device according to claim 11, characterized in that the spacer elements (15) comprise a spiral rib.

14. Blocking device according to claim 1, characterized in that the granular material (13) is an incompressible material.

15. Blocking device according to claim 1, characterized in that the granular material (13) comprises grains of irregular shape.

16. Blocking device according to claim 1, characterized in that the granular material (13) comprises grains having facets.

17. Blocking device according to claim 1, characterized in that the granular material (13) comprises grains of glass.

18. Blocking device according to claim 1, characterized in that the granular material (13) comprises grains of sand.

19. Blocking device according to claim 1, characterized in that it further includes:

an enclosure (16) adapted to receive the rigid base (2), the deformable pocket (3), and an optical element (14); and means (25) for reducing the pressure inside the enclosure (16).

20. Blocking device according to claim 19, characterized in that it further includes means (19) for retaining the rigid base (2) inside the enclosure (16).

21. Blocking device according to claim 20, characterized in that said retaining means (19) are mounted on a spring (22).

22. Blocking device according to claim 21, characterized in that said retaining means include a receptacle (19) mounted on a slideway (20), said spring (22) urging the receptacle (19) in the direction of the slideway (20).

23. Blocking device according to claim 20, characterized in that the enclosure (16) includes a cover (17) provided with means for urging an optical element (14) against the deformable pocket (3) when the rigid base (2) is in place in said retaining means (19).

24. Blocking device according to claim 19, characterized in that the enclosure (16) includes a cover (17) including retaining means (24) for an optical element (14).

25. Method of blocking an optical element, characterized in that it includes the following steps:

selecting a blocking device according to claim 19;

disposing the rigid base (2), the deformable pocket (3), and the lens (14) inside an enclosure (16) having an original pressure;

reducing the pressure inside the enclosure (16);

returning the interior of the enclosure (16) to the original pressure;

recovering the rigid base (2), the deformable pocket (3), and the lens (14) fastened together.

26. Blocking method according to claim 25, characterized in that it further includes, before the step of reducing the pressure inside the enclosure (16), the step of pressing one of the faces of the optical element (14) against the deformable pocket (3) so that the latter at least partially espouses the shape of the optical element (14).

* * * * *